US005299521A

United States Patent [19]

Loucks

[11] Patent Number: 5,299,521

[45] Date of Patent: Apr. 5, 1994

[54] BUMPER PROTECTOR FOR A WATERCRAFT

[76] Inventor: Jerry T. Loucks, R.D. #1, Box 45, Knoxville, Pa. 16928

[21] Appl. No.: 985,322

[22] Filed: Dec. 4, 1992

[51] Int. Cl.[5] ..... B63B 59/02

[52] U.S. Cl. ..... 114/219

[58] Field of Search ..... 114/219, 364; 405/211, 405/212, 215

[56] References Cited

U.S. PATENT DOCUMENTS 2,536,551 1/1951 Johnson ..... 114/219

2,577,236 12/1951 Doherty ..... 114/219

3,000,021 9/1961 Lang ..... 114/219

*Primary Examiner*—Sherman Basinger

*Attorney, Agent, or Firm*—Michael I. Kroll

[57] ABSTRACT

An improved bumper protector is provided for a watercraft having a gunwale and a hull, which consists of a flexible resilient sheet and a structure for securing the sheet to the gunwale. The sheet can hang down an outer side of the hull of the watercraft, so as to prevent damage to the gunwale and the outer side of the hull during docking and when rafting/tying two watercrafts together.

17 Claims, 2 Drawing Sheets

BUMPER PROTECTOR FOR A WATERCRAFT

BACKGROUND OF THE INVENTION

1. Field of the Invention

The instant invention relates generally to boat fenders and hull protectors and more specifically it relates to an improved bumper protector for a watercraft.

2. Description of the Prior Art

Numerous boat fenders and hull protectors have been provided in prior art that are adapted to prevent damage to the hulls of boats upon docking and when boats are beached upon the shore. While these units may be suitable for the particular purpose to which they address, they would not be as suitable for the purposes of the present invention as heretofore described.

SUMMARY OF THE INVENTION

A primary object of the present invention is to provide an improved bumper protector for a watercraft that will overcome the shortcomings of the prior art devices.

Another object is to provide an improved bumper protector for a watercraft that will prevent damage to the gunwale and an outer side of the hull during docking and when two watercrafts are rafted or tied together.

An additional object is to provide an improved bumper protector for a watercraft that can be readily wound into a roll for storage purposes and then unwound, so as to be mounted to the gunwale to hang down the outer side of the hull.

A further object is to provide an improved bumper protector for a watercraft that is simple and easy to use.

A still further object is to provide an improved bumper protector for a watercraft that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
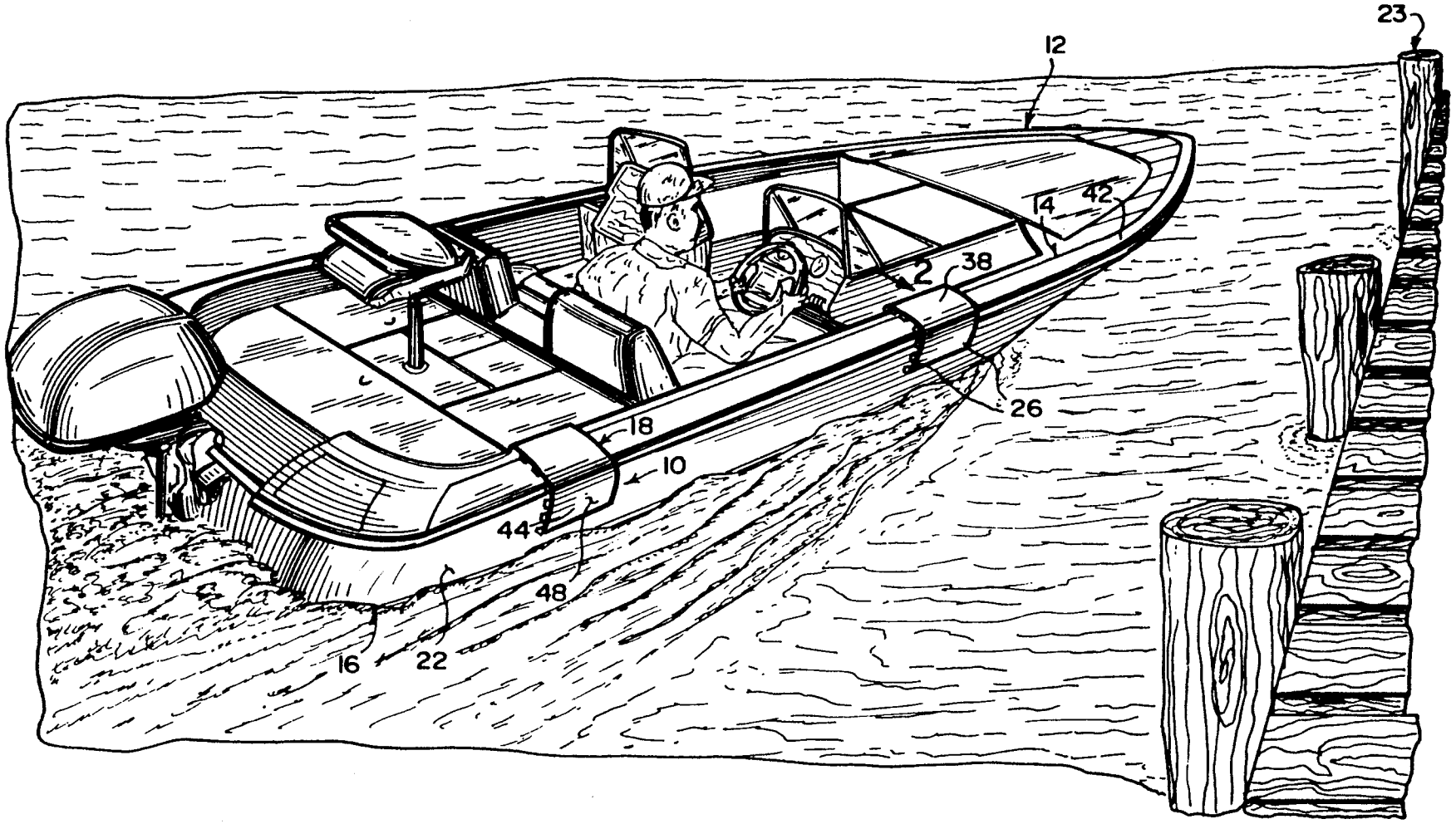
FIG. 1 is a perspective view of a watercraft with the instant invention mounted thereon.
Figure 2:
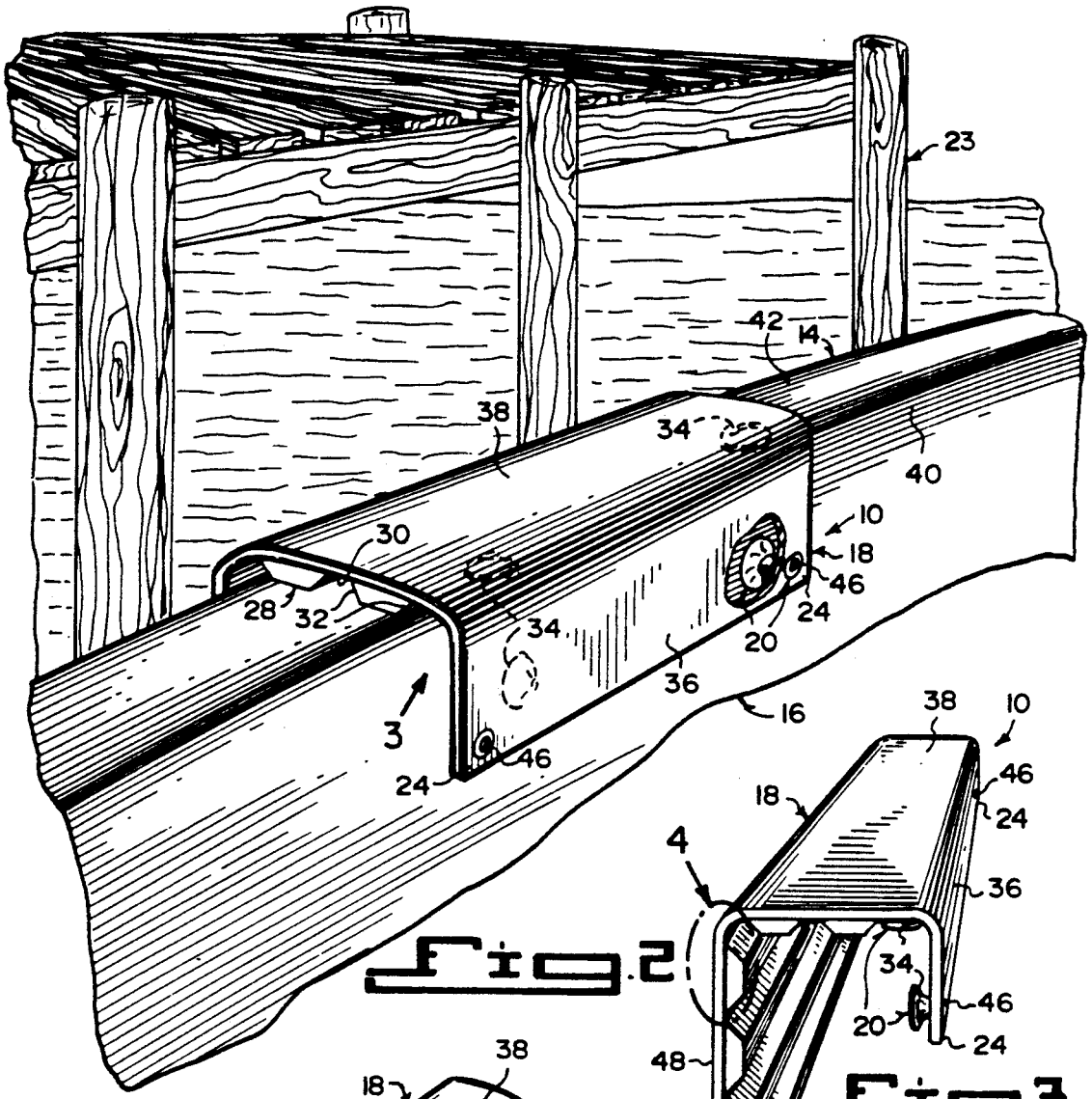
FIG. 2 is an enlarged perspective view with parts broken away taken in direction of arrow 2 in FIG. 1.
Figure 3:
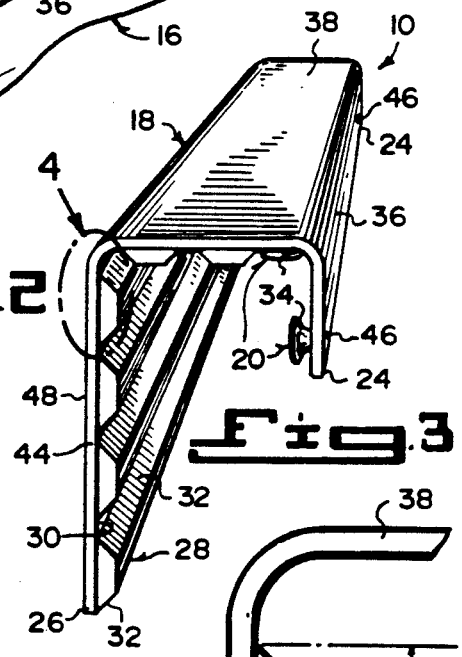
FIG. 3 is a perspective view taken in direction of arrow 3 in FIG. 2 of the instant invention per se.

Turning now descriptively to the drawings, in which similar reference characters denote similar elements throughout the several views, the Figures illustrate an improved bumper protector 10 for a watercraft 12 having a gunwale 14 and a hull 16, which consists of a flexible resilient sheet 18 and a structure 20 for securing the sheet 18 to the gunwale 14. The sheet 18 can hang down an outer side 22 of the hull 16 of the watercraft 12, so as to prevent damage to the gunwale 14 and the outer side 22 of the hull 16 during docking against a pier 23 and when rafting/tying two watercrafts 12 together (not shown).

Figure 5:
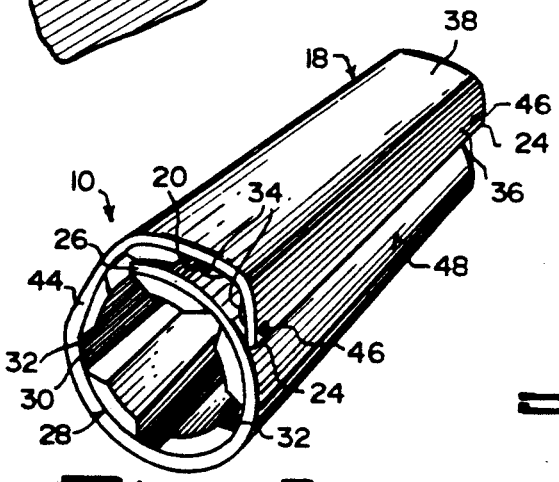
FIG. 5 is a perspective view of the instant invention in a rolled up storage position.
Figure 4:
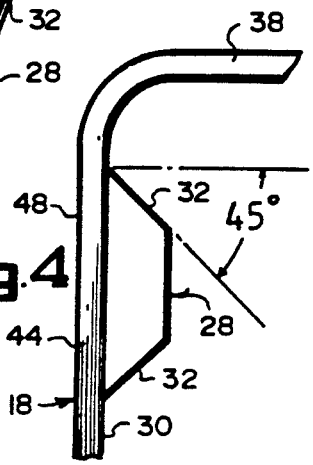
FIG. 4 is a still further enlarged end view of a portion of the instant invention as indicated by arrow 4 in FIG. 3.

The sheet 18 is substantially rectangular in shape with two upper corners 24 and two lower corners 26 and has a length substantially greater than the width thereof. The sheet 18 is capable of being wound into a roll along the long length thereof for storage purposes as shown in FIG. 5. The sheet 18 is fabricated out of a durable waterproof material.

The sheet 18 further includes six ribs 28 integrally formed in spaced apart parallel longitudinal relationships on a rear surface 30 thereof, between the lower corners 26 and the securing structure 20, so as to cushion the sheet 18 against the gunwale 14 and the outer side 22 of the hull 16. Each rib 28 includes each opposite long side 32 being angularly tapered inwardly. Each long side 32 of each rib 28 is angled at approximately forty-five degrees.

The securing structure consists of four suction cups 34 integrally formed on the rear surface 30 of the sheet 18 between the upper corners 24 and the uppermost rib 28, so as to retain an upper portion 36 and a middle portion 38 of the sheet 18 to an inner surface 40 and a top surface 42 of the gunwale 14, while a lower portion 44 of the sheet 18 can hang down the outer side 22 of the hull 16.

The sheet 18 has a width of approximately sixteen inches and a length of approximately twenty one inches. The upper portion 36 is approximately five inches and covers part of the inner surface 4 of the gunwale 14, the middle portion 38 is approximately seven inches and covers a part of the top surface 42 of the gunwale 14, while the lower portion 44 is approximately nine inches and hangs down a part of the outer side 22 of the hull 16.

Each rib 28 has a thickness of approximately one inch and is spaced apart approximately one inch from another rib 28. Each suction cup 34 is approximately three inches in diameter. The securing structure 20 further includes a pair of grommets 46, each located in one upper corner 24 of the sheet 18 for passing retainer lines therethrough.

The durable waterproof material of the sheet 18 with the ribs 28 and the suction cups 34 can be typically made of silicone, neoprene, natural rubber, urethane, special elastomers and similar substances.

A front surface 48 of the sheet can be especially textured for screen printing, for typically placing personal names, advertisement, sponsors and similar indica thereon.

To use the improved bumper protector 10 the following steps should be taken:

1. Press the suction cups 34 against the inner surface 40 and the to surface 42 of the gunwale 14.

2. Flip the sheet 18 over the gunwale 14, so that the lower portion 44 hangs down the outer side 22 of the hull 12.

3. Make sure that some of the ribs 28 sit properly upon the top surface 42 of the gunwale 14 and bear against the outer side 22 of the hull 12.

4. Utilize a second improved bumper protector 10 by following steps 1 through 3, making sure the first improved bumper protector 10 is spaced away from the second improved bumper protector 10 on the side of the watercraft 12, which will engage with the pier 23.

5. Remove the first improved bumper protector 10 and the second improved bumper protector 10 and roll them up for storage when they are no longer needed.

LIST OF REFERENCE NUMBERS

10 improved bumper protector
12 watercraft
14 gunwale of 12
16 hull of 12
18 flexible resilient sheet
20 securing structure
22 outer side of 12
23 pier
24 upper corner of 18
26 lower corner of 18
28 rib
30 rear surface of 18
32 long side of 28
34 suction cup
36 upper portion of 18
38 middle portion of 18
40 inner surface of 14
42 top surface of 14
44 lower portion of 18
46 grommet
48 front surface of 18

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved bumper protector for a watercraft having a gunwale and a hull, which comprises:

a) a flexible resilient sheet, said sheet further including six ribs integrally formed in spaced apart parallel longitudinal relationships on a rear surface thereof while a front surface thereof being free of said ribs, said ribs including opposite long sides being 45 degrees tapered inwardly while running horizontally; and b) means for securing said sheet to said gunwale, so that said sheet can hand down an outer side of said hull of said watercraft, so as to prevent damage to said gunwale and said outer side of said hull during docking said securing means including four suction cups integrally formed on said rear surface of said sheet between upper corners and an uppermost rib, so as to retain an upper portion and a middle portion of said sheet to an inner surface and a top surface of said gunwale.

2. An improved bumper protector for a watercraft as recited in claim 1, wherein said sheet is substantially rectangular in shape with two upper corners and two lower corners and having a length substantially greater than the width thereof.

3. An improved bumper protector for a watercraft as recited in claim 2, wherein said sheet is fabricated out of a durable waterproof material.

4. An improved bumper protector for a watercraft as recited in claim 3, wherein said sheet further includes said plurality of ribs being located between said lower corners and said securing means, so as to cushion said sheet against said gunwale and said outer side of said hull.

5. An improved bumper protector for a watercraft as recited in claim 4, wherein said sheet has a width of approximately sixteen inches and a length of approximately twenty one inches and in which said upper portion is approximately five inches and covers part of said inner surface of said gunwale, said middle portion is approximately seven inches and covers a part of said top surface of said gunwale, while a lower portion is approximately nine inches.

6. An improved bumper protector for a watercraft as recited in claim 5, wherein each said rib has a thickness of approximately one inch and is spaced apart approximately one inch from another said rib.

7. An improved bumper protector for a watercraft as recited in claim 6, wherein each said suction cup is approximately three inches in diameter.

8. An improved bumper protector for a watercraft as recited in claim 7, wherein said securing means further includes a pair of grommets, each located in one said upper corner of said sheet for passing retainer lines therethrough.

9. An improved bumper protector for a watercraft as recited in claim 8, wherein said durable waterproof material of said sheet with said ribs and said suction cups is made of silicone.

10. An improved bumper protector for a watercraft as recited in claim 8, wherein said durable waterproof material of said sheet with said ribs and said suction cups is made of neoprene.

11. An improved bumper protector for a watercraft as recited in claim 8, wherein said durable waterproof material of said sheet with said ribs and said suction cups is made of natural rubber.

12. An improved bumper protector for a watercraft as recited in claim 8, wherein said durable waterproof material of said sheet with said ribs and said suction cups is made of urethane.

13. An improved bumper protector for a watercraft as recited in claim 8, wherein said durable waterproof material of said sheet with said ribs and said suction cups is made of special elastomers.

14. An improved bumper protector for a watercraft as recited in claim 8, wherein a front surface of said sheet is especially textured for screen printing, for typically placing personal names, advertisements, sponsors and similar indicia thereon.

15. An improved bumper protector for a watercraft as recited in claim 14, wherein said sheet is capable of being wound into a roll along said length thereof for storage purposes.

16. An improved bumper protector for a watercraft as recited in claim 15, wherein said lower portion of said sheet hangs down said outer side of said hull.

17. An improved bumper protector for a watercraft as recited in claim 16, wherein said sheet is capable of being rolled up for storage.

* * * * *